US006604639B2

(12) United States Patent
Chen

(10) Patent No.: US 6,604,639 B2
(45) Date of Patent: Aug. 12, 2003

(54) DISPLAY RACK FOR ROLLER BOARD

(76) Inventor: Chin-Tsug Chen, No. 23, Alley 33, Lane 24, Sec. 3, Jungyang Rd., Lungjing Shiang, Taichung (TW)

( * ) Notice: Subject to any disclaimer, the term of this patent is extended or adjusted under 35 U.S.C. 154(b) by 0 days.

(21) Appl. No.: 10/045,145

(22) Filed: Jan. 15, 2002

(65) Prior Publication Data

US 2003/0132180 A1 Jul. 17, 2003

(51) Int. Cl.[7] ..... A47F 7/00

(52) U.S. Cl. ..... 211/85.7; 211/41.2; D6/552; 248/460; 248/346.3

(58) Field of Search ..... 211/85.7, 41.2; D6/552; 248/346.3, 460

(56) References Cited

U.S. PATENT DOCUMENTS 2,422,261 A * 6/1947 Richards
2,528,388 A * 10/1950 Richards
3,282,437 A * 11/1966 Hansen
3,999,734 A * 12/1976 Gibson et al. ..... 248/460
4,343,450 A * 8/1982 Anderson ..... 248/460 X
4,957,263 A * 9/1990 Leluan
5,799,915 A * 9/1998 Morey
5,833,078 A * 11/1998 York ..... 211/70.5
5,833,079 A * 11/1998 Roberts ..... 211/85.7
6,196,397 B1 * 3/2001 Maher ..... 211/85.7

* cited by examiner

*Primary Examiner*—Robert W. Gibson, Jr.
(74) *Attorney, Agent, or Firm*—Rosenberg, Klein & Lee

(57) ABSTRACT

A roller board display device includes a base having two lugs on a side thereof and two stubs extend from bottom of said base so that the display devices can be connected in series by inserting the stubs in the holes of lugs. A rest board is connected to said top surface of said base and a recess is defined in said rest board. One of the roller frame is engaged with the notch in the rest board and an end of the roller board is engaged with two recesses defined in a top surface of the base. A side of the roller board may also be engaged with the two recesses and the other side of the roller board is rested on the rest board.

4 Claims, 9 Drawing Sheets

DISPLAY RACK FOR ROLLER BOARD

FIELD OF THE INVENTION

The present invention relates to a display rack on which a roller board is engaged. The display racks can be connected in series for convenience of display.

BACKGROUND OF THE INVENTION

A conventional roller board is received in a paper board made casing 10 which has an opening 100 and two folded ends 101. The roller board is inserted in the opening 100 and two ends of the board is engaged with the two folded ends 101. The package casing 10 is bulky and not convenient to be displayed on rack.

FIGS. 2 and 3 respectively show the other two types of display racks 12, 13. The display rack 12 is connected to one of two sets of the rollers and can be hung on a wall. The other display rack 13 secures one of two sets of the rollers and includes a wide bottom so as to be put on the ground. The display rack 12 needs a nail on the wall to be hung thereon and when taking the roller board out from the display rack 12, the display rack 12 will be usually broken. The display rack 13 still too bulky.

SUMMARY OF THE INVENTION

In accordance with one aspect of the present invention, there is provided a roller board display device which comprises a base having two lugs extending from a side thereof and each of said lugs has a hole. Two stubs extend from a bottom of said base and are located at a first side of said base so as to be connected to the two lugs. A rest board is connected to said top surface of said base and located close to a second side of said base. The second side is located in opposite to said first side of said base. A recess is defined in said rest board.

The primary object of the present invention is to provide a roller board display device that has a compact volume and the roller board is easily to be positioned on the display device in two directions.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
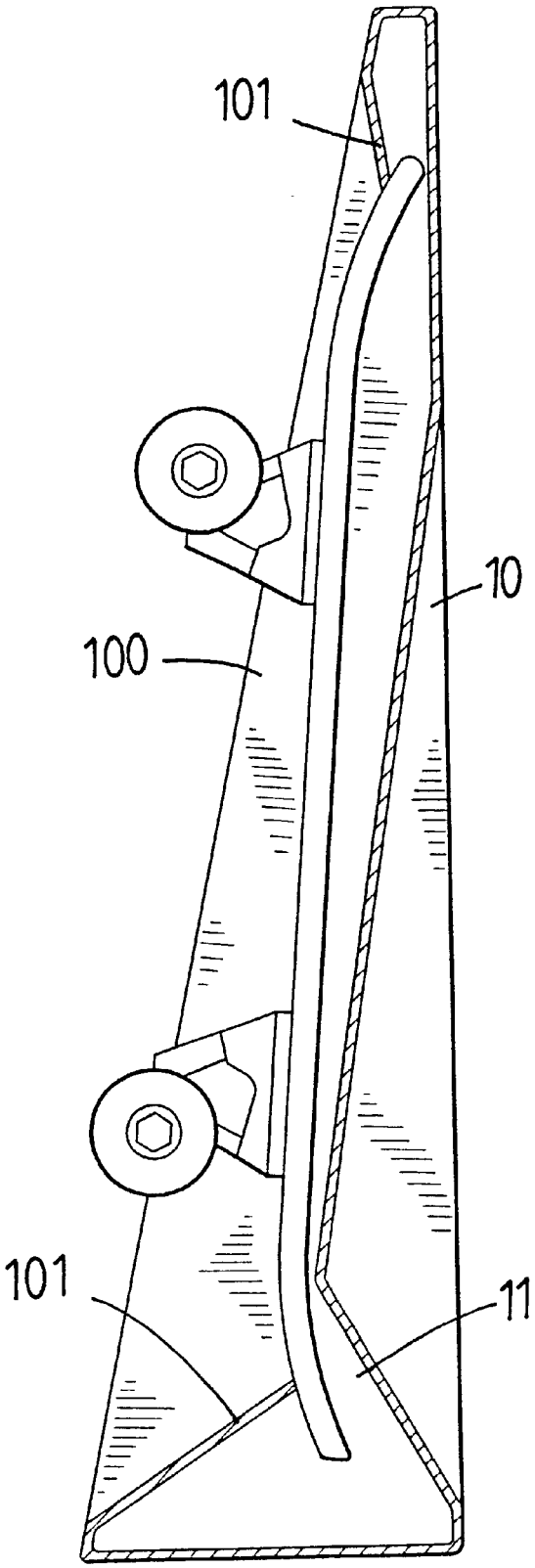
FIG. 1 PRIOR ART
FIG. 1 is a side view to show a first conventional roller board display casing.
Figure 2:
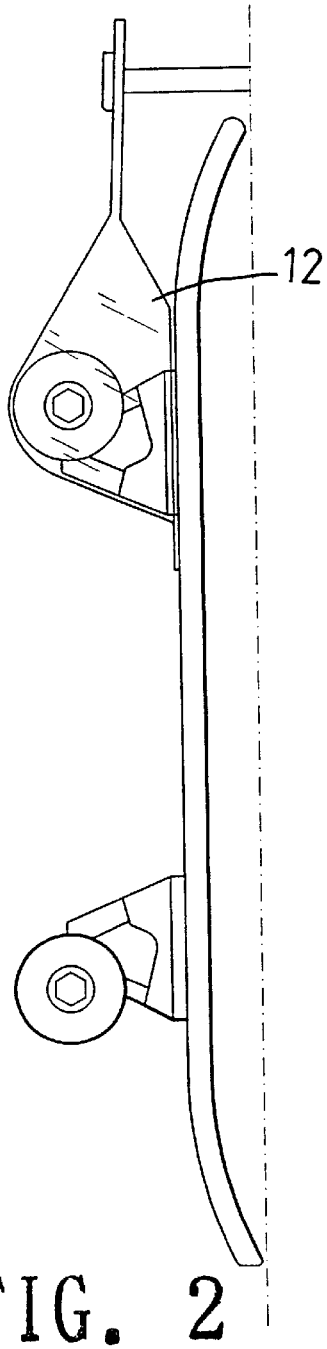
FIG. 2 PRIOR ART
FIGS. 2 and 3 show two types of conventional roller board display racks.
Figure 3:
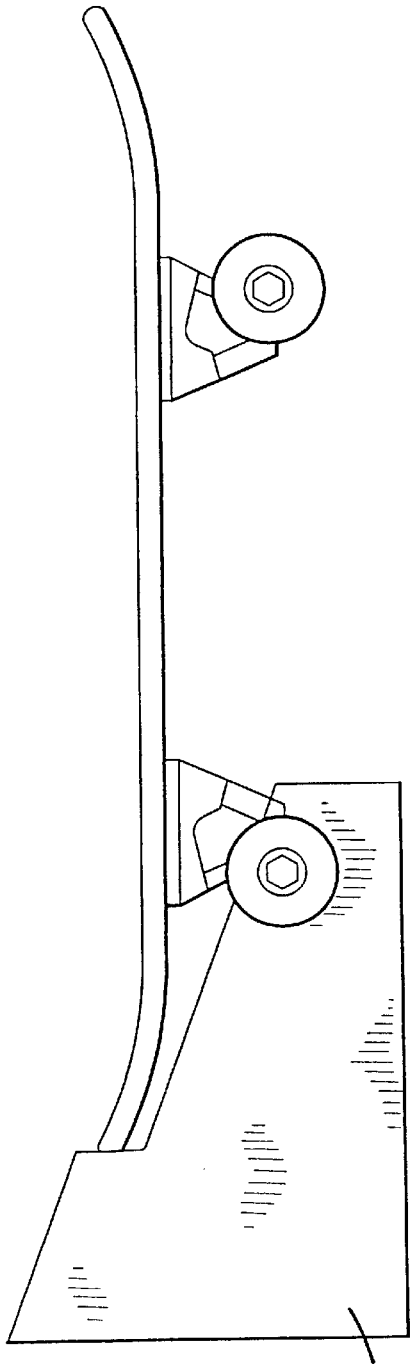
FIG. 3 PRIOR ART
Figure 4:
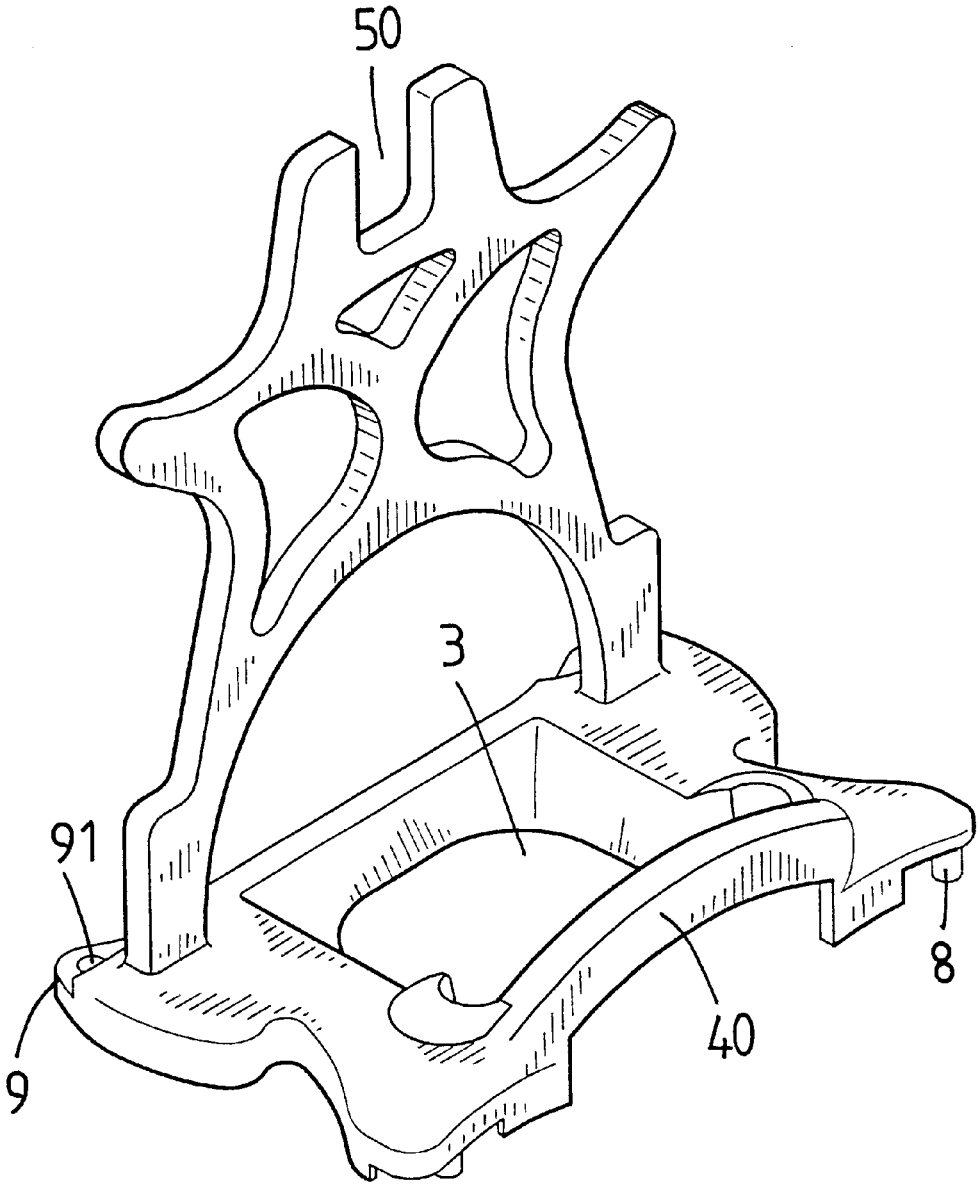
FIG. 4 is a perspective view to show the roller board display device of the present invention, wherein the rest board is integral with the base.
Figure 11:
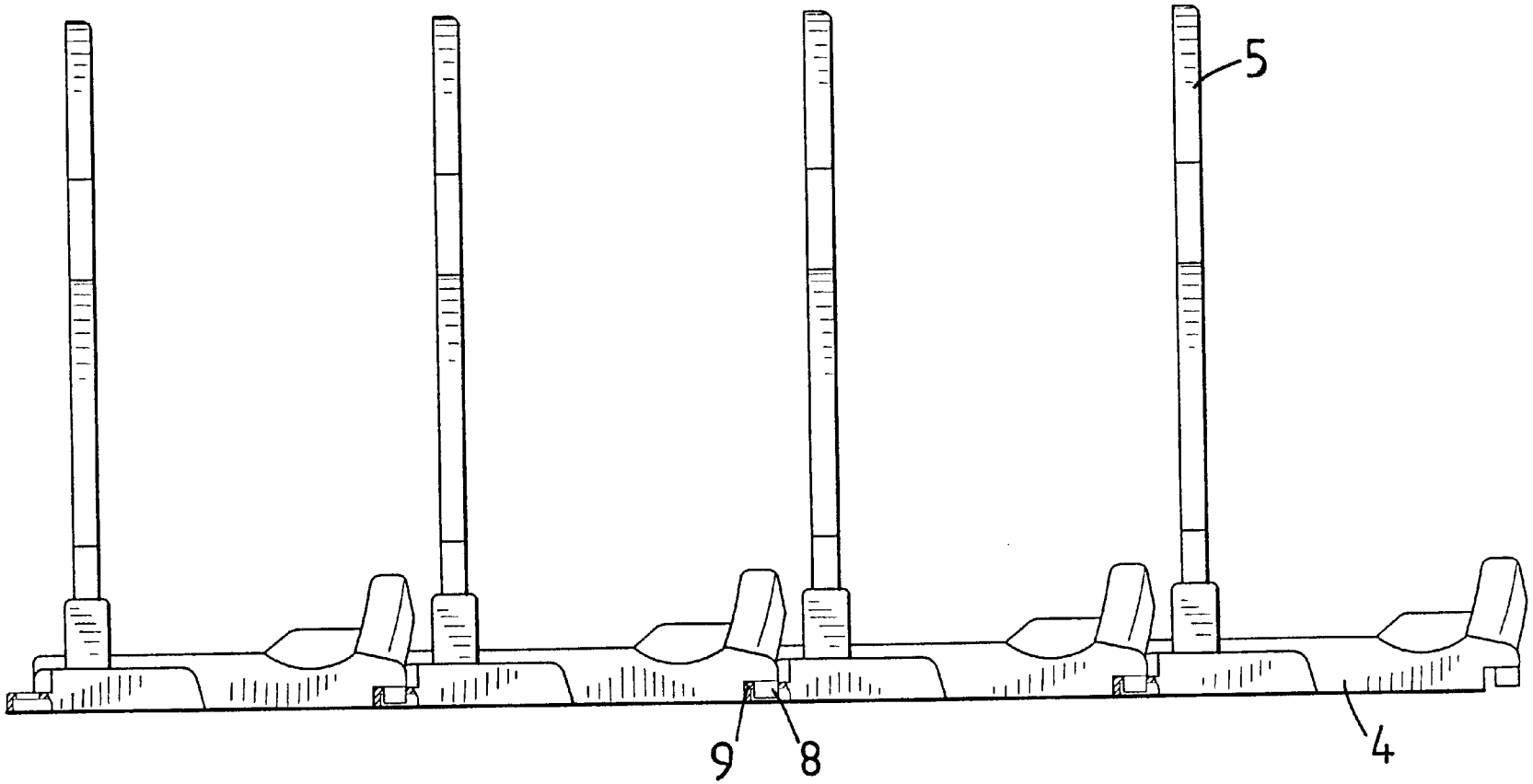
FIG. 11 shows the roller board display devices of the present invention are connected with each other.

Referring to FIG. 4, the roller board display device of the present invention comprises a base 4 having an opening 3 defined through a central portion thereof and two stubs 8 extend from a bottom of said base 4 and located at a first side of said base 4. Two lugs 9 extend from a second side of the base 4 and each of said lugs 9 has a hole 91 defined therethrough so that the display devices can be connected in series by inserting the stubs 8 into the holes 91 of the lugs 9 as shown in FIG. 11.

A rest board 5 is connected to said top surface of said base 4 and located close to the second side of said base 4. The second side is located in opposite to said first side of said base 4. A recess 50 is defined in said rest board 5.

Figure 5:
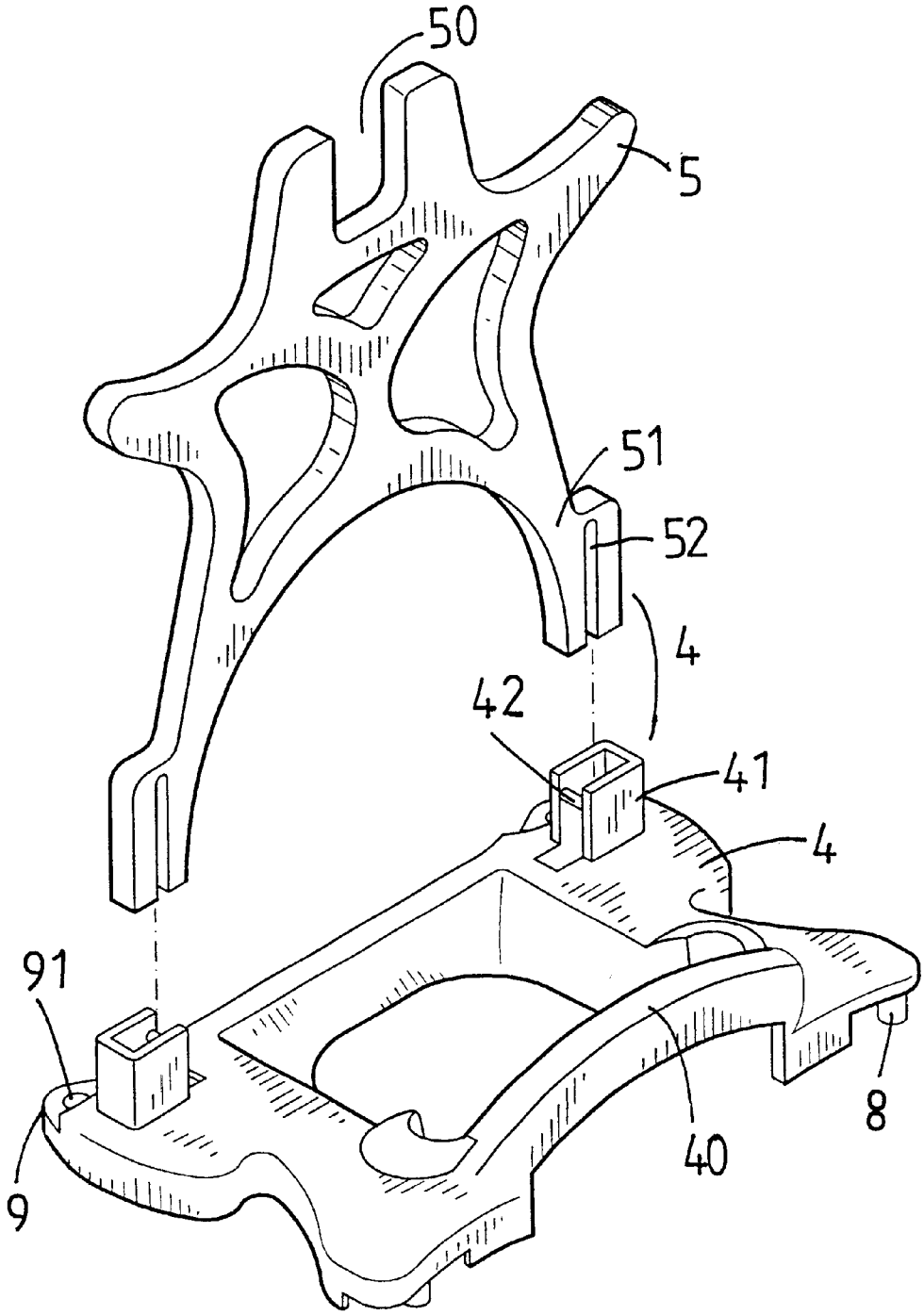
FIG. 5 is an exploded view to show the roller board display device of the present invention, wherein the rest board can be disengaged from the base.

The rest board 5 can also be assembled to the base 4 as shown in FIG. 5, wherein two tubes 41 extend from said top surface of said base 4 and said rest board 5 has two insertions 51. Each of the tubes 41 has an open side and a rod 42 is located in the open side. Each of said insertions 51 has a notch 52 so that the rest board 5 is connected to the base 4 by engaging the rod 42 of each of said tubes 41 in the notch 52 of the corresponding insertions 51.

Figure 9:
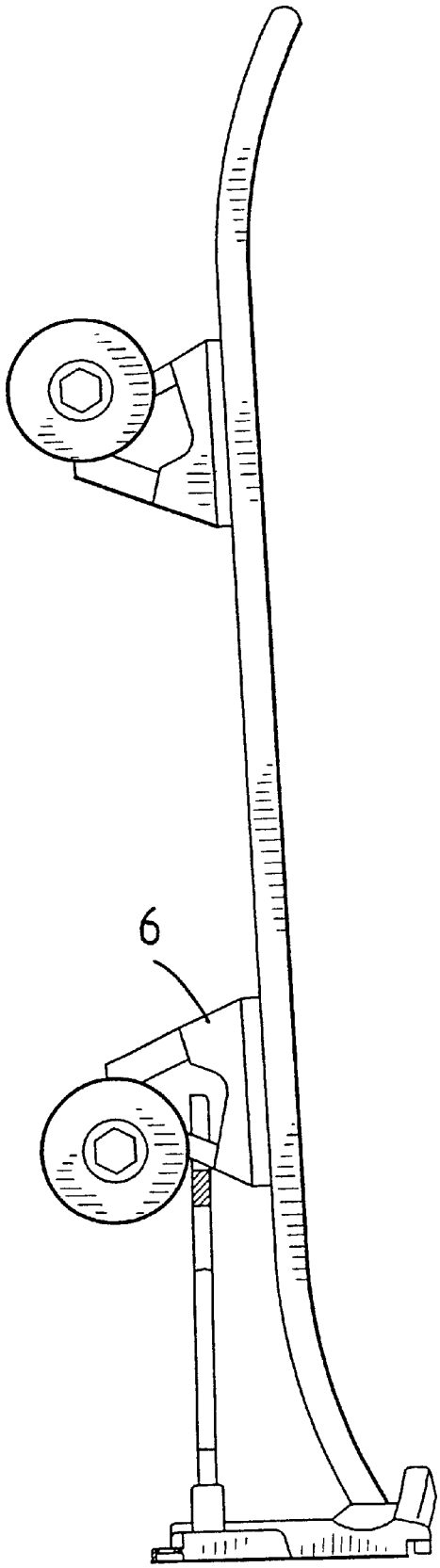
FIG. 9 shows a roller board is engaged with the roller board display device of present invention in an upright position.

A flange 40 extends from said top surface of said base 4 and is located close to said first side of said base 4. As shown in FIG. 9, one of the two roller frames 6 of the roller board is engaged with the recess 50 of the rest board 5 and an end of the board is engaged with the opening 3. The flange 40 prevents the end of the board from disengaging from the opening 3.

Figure 10:
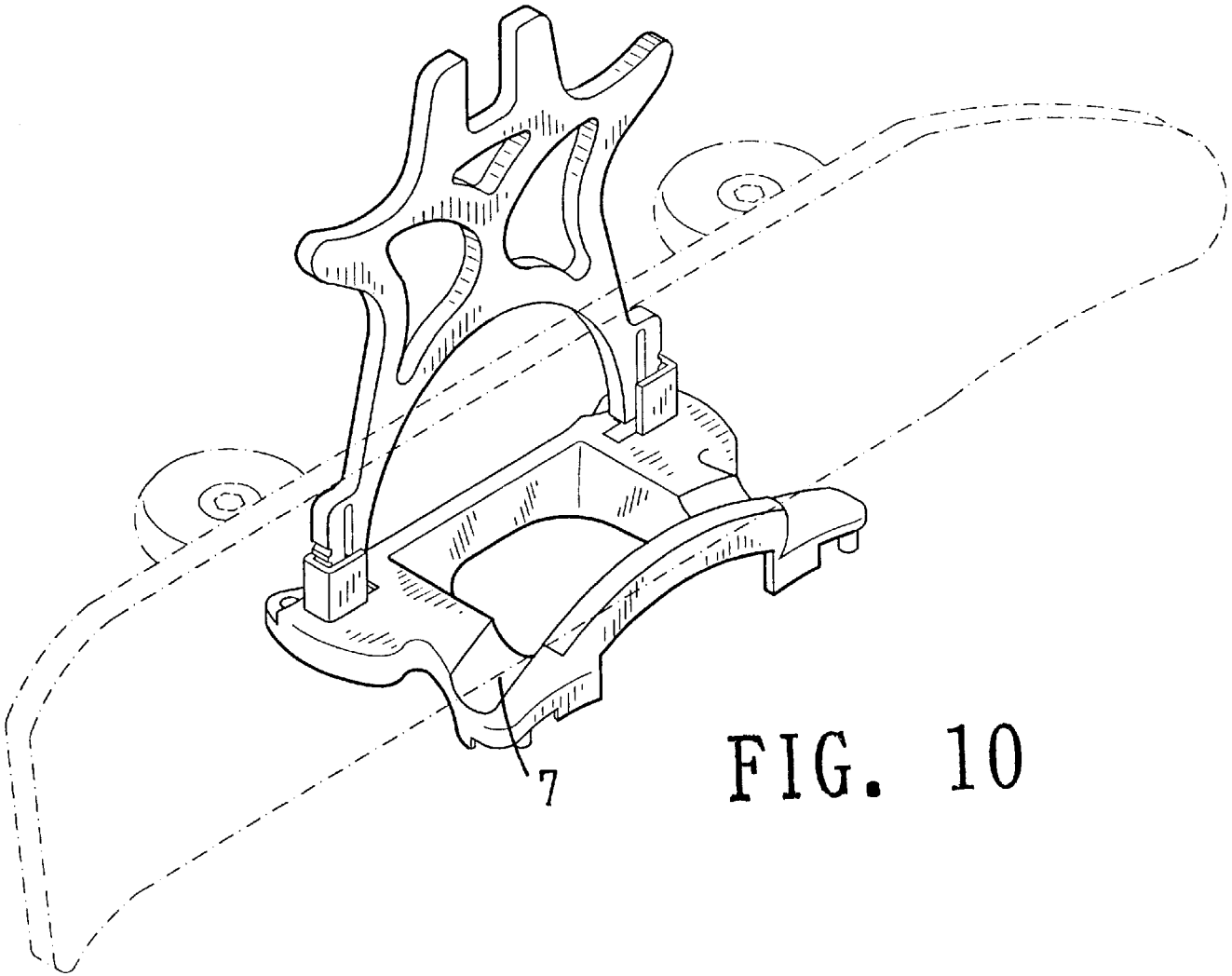
FIG. 10 shows a roller board is engaged with the roller board display device of the present invention in a horizontal position.

As shown in FIG. 10, two recesses 7 are defined in two opposite insides of said opening 3 and a side of the roller board can be supported in the two recesses 7 and the other side of the roller board is rested on the rest board 5.

Figure 6:
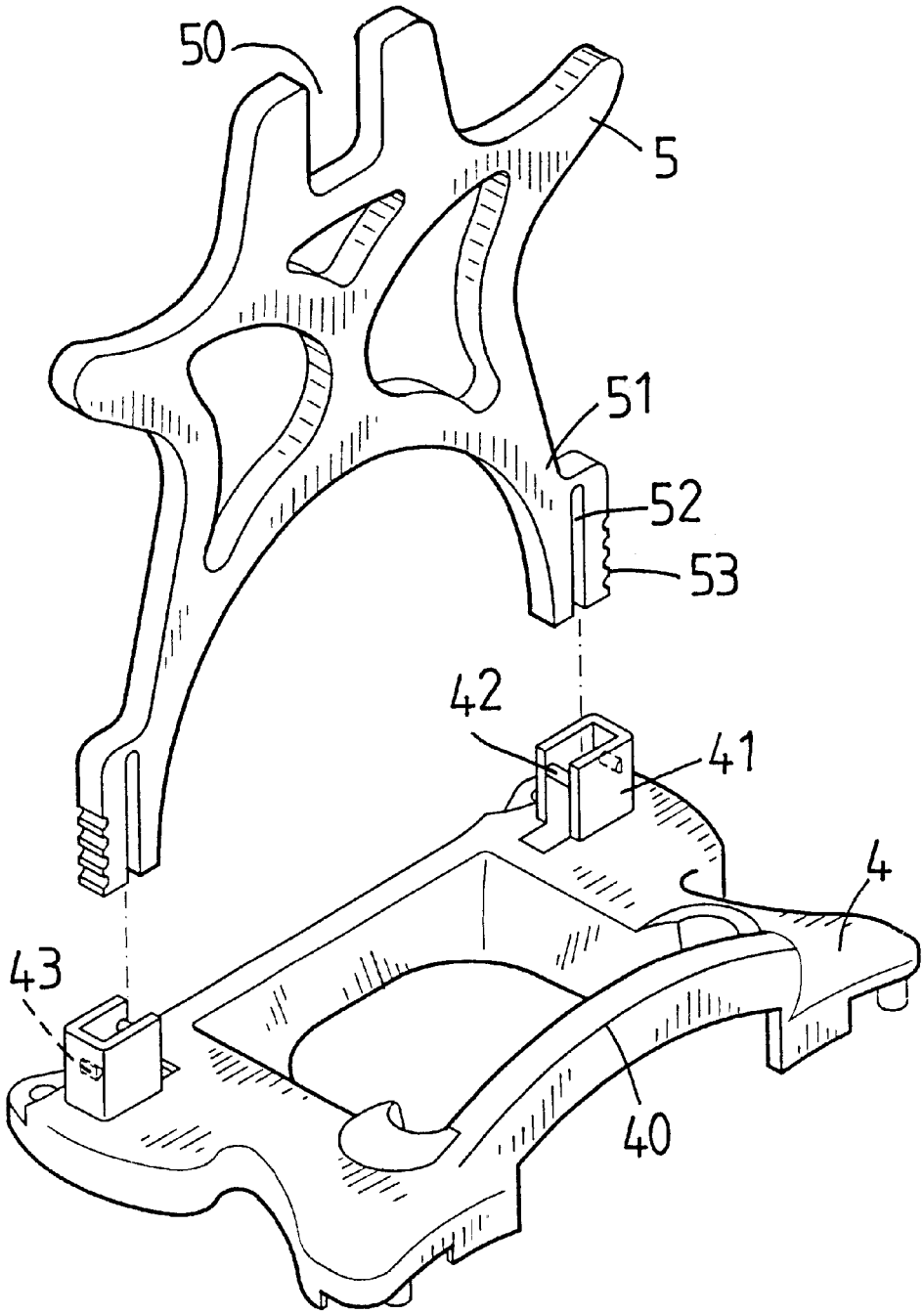
FIG. 6 is an exploded view to show another embodiment of the roller board display device of the present invention.
Figure 7:
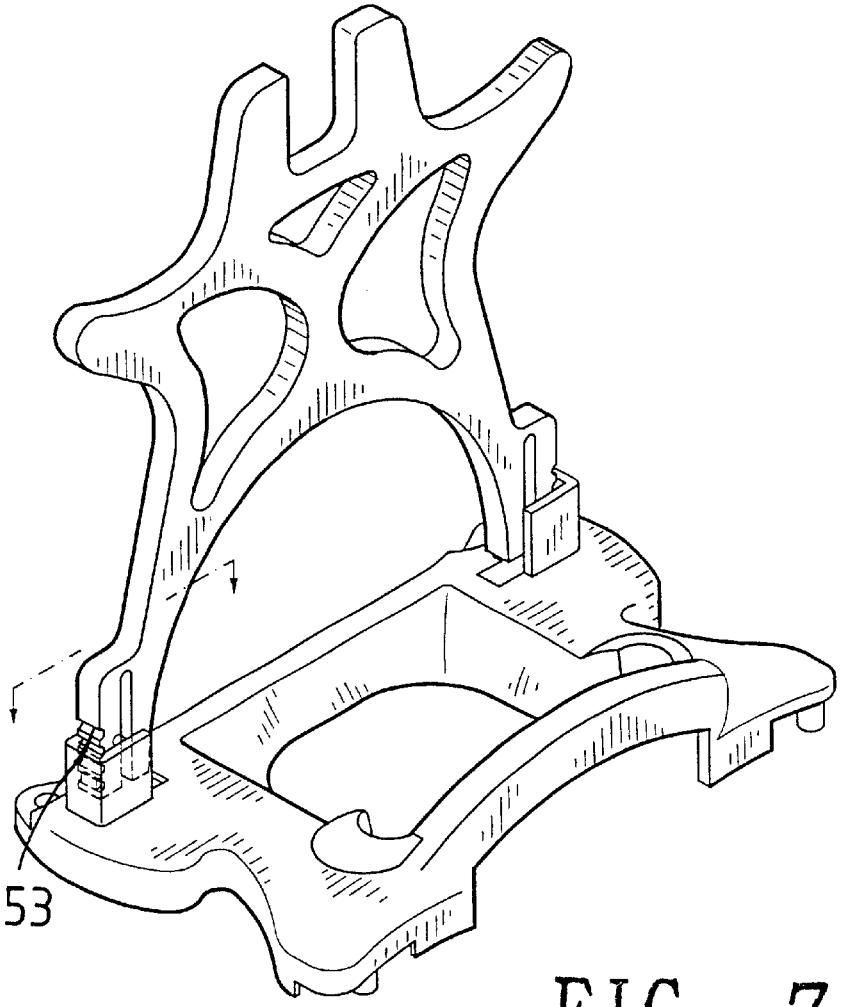
FIG. 7 is a perspective view to show the roller board display device of the present invention as shown in FIG. 6.
Figure 8:
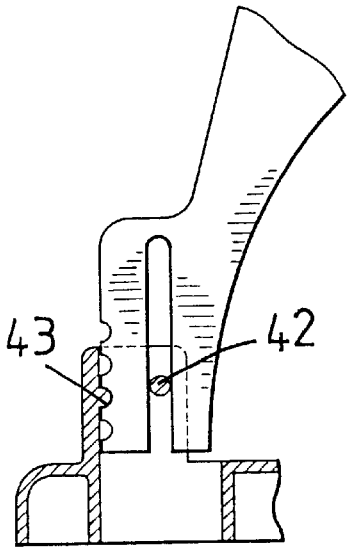
FIG. 8 is a cross sectional view to show the engagement of the insertion and the tube of the roller board display device of the present invention as shown in FIG. 6.

Referring to FIGS. 6 to 8, each of said insertions 51 may have a toothed surface 53 and each of said tubes 41 has a rib 43 extending from an inside thereof. The insertions 51 are securely engaged with the tubes 41 by engaging the ribs 43 with said toothed surface 53.

The Display Device

While we have shown and described the embodiment in accordance with the present invention, it should be clear to those skilled in the art that further embodiments may be made without departing from the scope of the present invention.

What is claimed is:

1. A roller board display device comprising:

a base (4) having two stubs (8) extending from a bottom of said base (4) and located at a first side of said base (4), two lugs (9) extending from a second side of said base and each of said lugs (9) having a hole (91) defined therethrough, two tubes (41) extending from a top surface of said base (4), and a rest board (5) having two insertions (51) and each of said insertions (51) having a notch (52) so as to receive a wall (42) of said tubes (41) which are located close to said second side of said base (4), said second side being located in opposite of said first side of said base (4) and a recess (50) defined in said rest board (5).

2. The display device as claimed in claim 1 further comprising an opening (3) defined through said base (4) and two recesses (7) defined in two opposite insides of said opening (3).

3. The display device as claimed in claim 1 further comprising a flange (40) extending from said top surface of said base (4) and located close to said first side of said base (4).

4. The display device as claimed in claim 1 wherein each of said insertions (51) has a toothed surface (53) and each of said tubes (41) has a rib (43) extending from an inside thereof so as to be engaged with said toothed surface (53).

* * * * *